US005605109A

United States Patent [19]

Merten et al.

[11] Patent Number: 5,605,109

[45] Date of Patent: Feb. 25, 1997

[54] POWER STEERING SYSTEM

[75] Inventors: Timothy W. Merten, Winnebago County; James M. Hundertmark, Fond du Lac County, both of Wis.

[73] Assignee: Performance 1 Marine, Inc., Overland Park, Kans.

[21] Appl. No.: 422,894

[22] Filed: Apr. 17, 1995

[51] Int. Cl.[6] ..... B63H 25/22

[52] U.S. Cl. ..... 114/150; 440/61

[58] Field of Search ..... 114/150; 440/61, 440/62; 180/132, 136, 137; 91/59, 509, 510; 92/51, 52, 134, 109

[56] References Cited

U.S. PATENT DOCUMENTS 4,933,617 6/1990 Huber et al. ..... 114/150

5,228,405 7/1993 Merten ..... 114/150

5,447,456 9/1995 Nakayasu ..... 114/150

*Primary Examiner*—Jesus D. Sotelo

*Attorney, Agent, or Firm*—R. Jonathan Peters

[57] ABSTRACT

In a power steering system for a marine vehicle having a propulsion unit and an operator actuatable steering helm, a power steering assist apparatus including a hydraulic fluid cylinder-piston assembly and actuated in response to steering actuation at the steering helm, and controls for maintaining anti-feed back upon a failure in the fluid source including a valve to establish fluid communication between a fluid source for the cylinder-piston assembly and the chamber in the assembly to either side of the piston thereby maintaining the chamber substantially full of hydraulic fluid during steering to effect movement of the piston upon steering actuation.

6 Claims, 9 Drawing Sheets

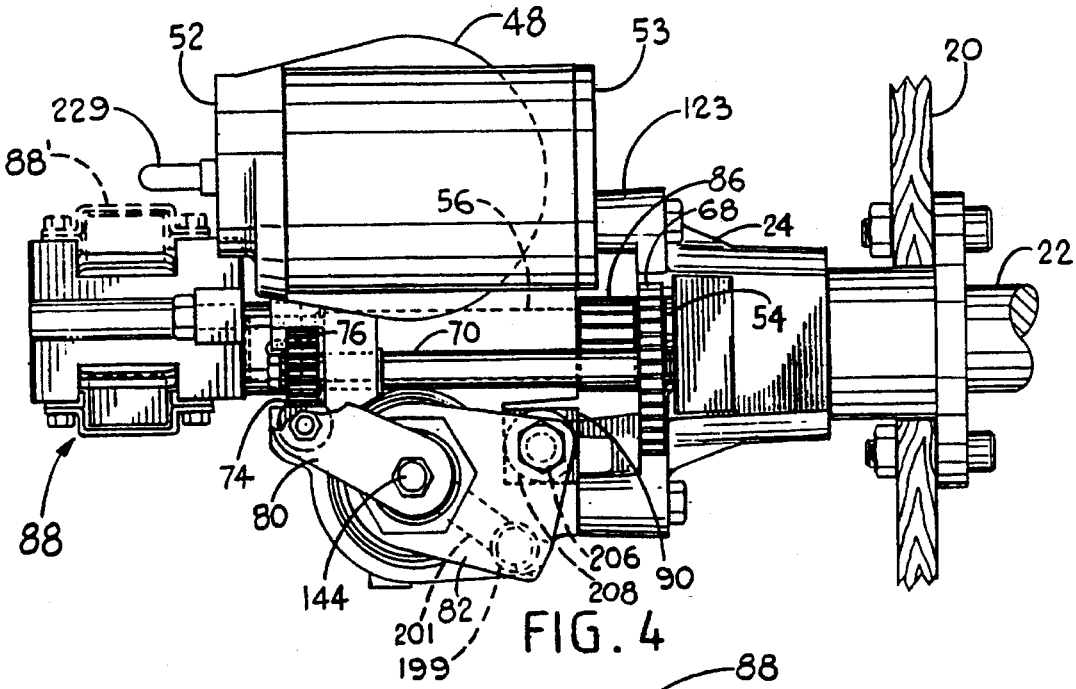
FIG. 4
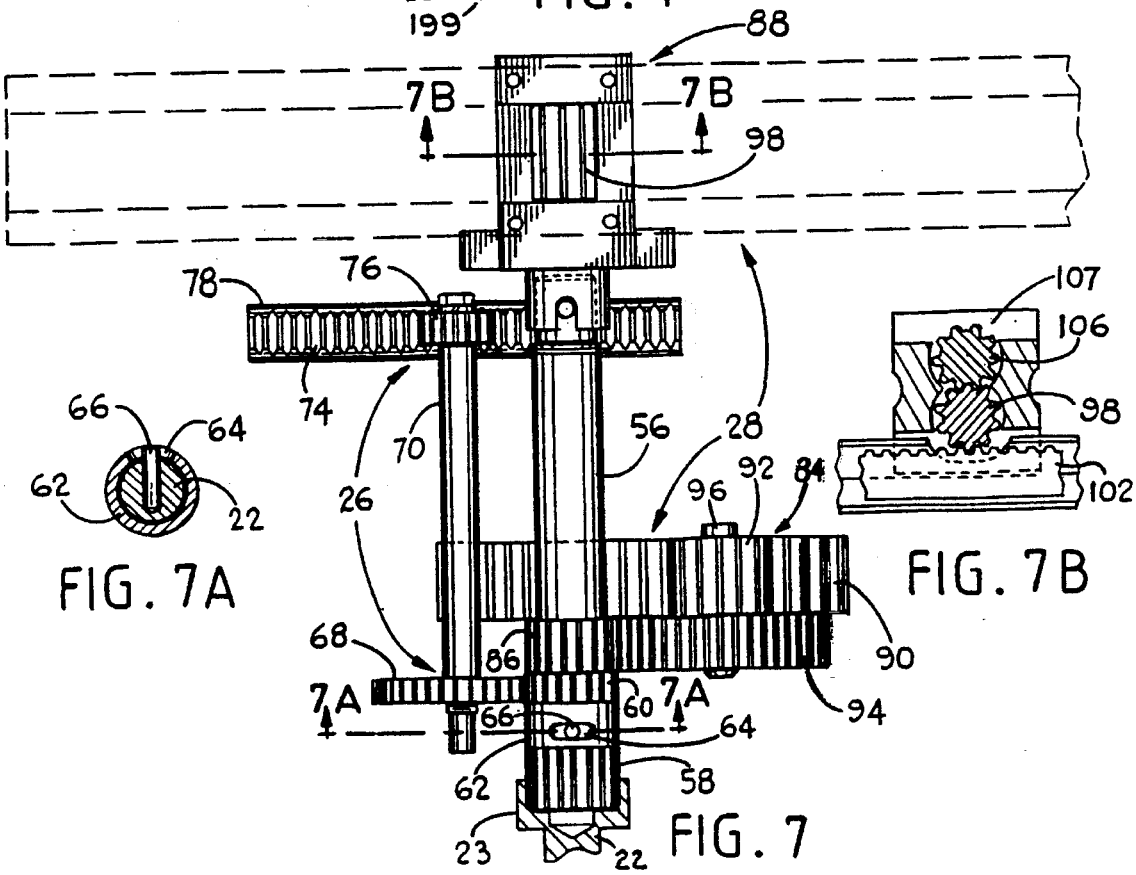
FIG. 7A
FIG. 7B
FIG. 7

POWER STEERING SYSTEM

FIELD OF THE INVENTION

This invention relates to a power steering system. In its more specific aspect, this invention relates to a power steering system, particularly for marine vehicles, and utilizing control means for maintaining anti-feed back upon a failure in the power steering system.

BACKGROUND AND PRIOR ART

In a conventional steering system such as for outboard motors used on boats, the propulsion unit or engine typically mounted on the transom of the boat is pivoted about a vertical steering axis upon steering actuation by the operator at the helm. One typical steering system for a boat having a transom mounted engine comprises a steering cable, such as a push-pull cable, extending between the steering helm and the propulsion unit so that steering at the helm actuates the cable for causing steering movement of the propulsion unit about a steering axis. One end of the cable is actuably connected to the steering helm, and the other end is actuably connected to the steering mechanism of the propulsion unit. When the wheel is turned at the helm, the cable is actuated thereby causing a steering movement of the propulsion unit. Hydraulic activated steering means can be used in place of the cable steering, wherein hydraulic fluid, e.g. oil, is pumped from the steering helm through conduits to a cylinder-piston control means in response to rotation of the steering wheel in one direction or the other. Actuation of the control means actuates the steering mechanism of the propulsion unit, thereby turning the propulsion unit in a common direction.

The prior art also teaches power steering systems for an outboard utilizing a hydraulic cylinder-piston assembly and push-pull cables to selectively extend and retract the piston rod and thereby effect steering of the propulsion unit. Typically, such power steering systems are mounted onto and supported by the propulsion unit, which is disadvantageous because special bracketry is required, the supply lines are subject to exposure and abuse, and most of these systems are designed to continuously supply fluid to the system, and not just when steering movement occurs which wastes propulsion engine horsepower.

Power steering systems for marine vehicles mounted remote from the propulsion unit, and overcoming the several disadvantages of the prior art, are disclosed in U.S. Pat. No. 5,228,405, and in co-pending U.S. patent application Ser. No. 08/012,552, both of which are assigned to the same assignee as the subject application, and are incorporated by reference into this specification.

In a hydraulic power steering system, such as of the types described above, torque originating from the propulsion unit is overcome, thereby restraining the steering forces created by this torque. That is, the power steering means reduces the effort at the steering helm or wheel to only the effort required to operate the hydraulic assembly, which is independent of the torque generated by the propulsion unit. There is the possibility, however, that the fluid supply means or source might fail, usually as the result of an electrical failure such as with the battery or some part of the motor. In the event of failure, steering at the helm will quickly deplete or pump out the hydraulic fluid (e.g., pressurized oil) from the cylinder-piston assembly of the system, and because of the failure, the cylinder-piston assembly cannot be maintained or replenished with hydraulic fluid. That is, when the operator turns the wheel, the piston is actuated and hydrualic fluid in the cylinder chamber is forced out or pumped out of the chamber on either the upstroke side of the piston or the downstroke side of the piston, depending on the direction of turn, thereby depleting the hydrualic fluid in the chamber. Because of the failure in the system, there is no means for maintaining hydrualic fluid in the cylinder, or to replenish the cylinder with fluid, so as to maintian a hydraulically locked system. As a consequence, if the fluid is substantially depleted from the cylinder-piston assembly, or essentially no fluid remains, the piston is not actuated or reciprocated by hydraulic pressure, and there is no means for restraining the steering forces or torque created by the propulsion unit except for manual steering. The piston is free to move but has no effect on the steering actuation (the cylinder-piston assembly is not hydraulically locked), and torque originating from the propulsion unit will feed back to the steering helm. The boat can be steered manually, but the torque feed-back requires a strong steering wheel effort to maintain the boat in a straight line or to turn the boat. If a firm grip is not maintained, the boat can suddenly make an abrupt turn in one direction or the other, thereby creating a dangerous and hazardous condition.

This invention has as its purpose to provide in such a power steering system utilizing a hydraulic cylinder, means for maintaining anti-feed back in the event of a failure by preventing loss of hydraulic fluid in the cylinder.

SUMMARY OF THE INVENTION

In accordance with the present invention, there is provided a power steering system for a marine vehicle, such as for an outboard, having a steering helm and propulsion unit pivotal about a steering axis. The power steering system comprises a power steering assist means having a hydraulic cylinder, preferably interposed between the propulsion unit and the steering helm and mounted remote from the propulsion unit, and actuatable input means is operably connected (a) to the helm and (b) to the power steering assist means, to effect actuating input to the power steering assist means upon actuation at the steering helm. Actuatably output means is operably connected (a) to the power steering assist means for operative movement in response to the actuating input, and (b) to the actuatable steering means operably connected to the propulsion unit for providing actuable output to the propulsion unit to effect steering movement thereof about the steering axis. The steering helm typically includes a steering wheel and is operator actuatably, and the actuatably input means is operably connected at one end to the steering helm and at the opposed end to the power steering assist means, which is actuated in response to rotation of the steering wheel. The power steering assist means includes a hydraulic fluid cylinder-piston assembly having a reciprocally mounted piston thereby defining or forming opposed chambers, i.e., a first chamber on one side of the piston and a second chanber on the opposite side of the piston (such as one chamber on the upstroke side of the piston and the other chamber on the downstroke side of the piston), to accommodate hydraulic fluid to either side of the piston. The power steering assist means includes valve control means normally biased to a closed position, and a hydraulic fluid source means for delivering pressurized hydraulic fluid to the cylinder-piston assembly. Suitable actuating means regulates the flow of hydraulic fluid through the power steering assist means. This invention includes control means for maintianing anti-feed back upon failure of the fluid supply system (e.g., battery failure). Thus, to prevent loss of hydraulic fluid in the cylinder-piston assembly of the power steering assist means, a control means comprises a second valve control means to permit delivery of hydraulic fluid from the fluid source means to the cylinder chamber and to one side or the other of the piston depending on the piston stroke or steering direction. In this manner, hydaulic fluid is maintained in the cylinder on both sides of the piston, that is, on both the upstroke side of the piston and on the downstroke side. The system is hydraulically locked in that there is no feed-back of torque from the propulsion unit to the steering wheel. Because the hydraulic fluid is on both sides of the piston, the piston will not move or reciprocate except upon input from manual steering. That is, the fluid is maintained in the cylinder and on both sides of the pistion during manual steering effecting reciprocal movement of the the piston. When in a neutral or no-steering position, the system is hydraulically locked.

In a preferred embodiment, the actuatably input means comprises a gear drive means, and the actuatably output means comprises a gear output means operably connected to the power steering assist means for operative movement in response to the actuation of the power steering assist means. Actuatably steering means is operably connected at one end to the gear output means and responsive to operative movement of the gear output means for overcoming torque on the propulsion unit relative to the steering axis in response to actuatably movement of said actuatably steering means. At its opposed end, the actuatably steering means is operably connected to the steering member of the propulsion unit for effecting common movement of the steering member in response to actuatably movement of the actuatably steering means upon steering actuation of the steering helm to pivot the propulsion unit about the steering axis.

It is prefereable that the power steering assist means is interposed between the helm and the propulsion unit or engine and mounted remote from the propulsion unit, and as used herein and in the appended claims the term "interposed between" is not restricted to the actual physical arrangement, but rather to the operable arrangement in that, for example when viewed in plan, the helm optionally can be arranged between the other two members, but in fact the power steering assist means is the operably interposed member. Further, regardless of the apparent physical arrangement, the power steering assist means is mounted remote from the propulsion unit.

Broadly, the gear drive means as a preferred actuatable input means includes an input driven gear operative in response to rotation of the steering shaft. The gear output means, as the preferred embodiment, comprises a first output gear operably connected to the input driven gear, and output driven gear operably engagable with the first output gear, and a second output gear operably connected to the output driven gear. Where desired, the actuatably output means may comprise a hydraulic operated means. In a preferred embodiment, the input driven gear further includes an input driving gear operably connected to an input rack and pinion, which operably engages the actuating means for regulating the flow of hydraulic fluid through the power steering assist means. The input driving gear, rotatably mounted as on the steering shaft, effects translation of the input rack which in turn actuates the power steering assist means. For the gear output means, the first output gear includes a first rack and pinion operably responsive to the actuation of the power steering assist means, and, preferably, a second output rack and pinion operably connected to the first output rack and pinion to effect translation of the second output rack. The actuatable steering means is operably connected to the second output rack, and lateral movement of this second rack then effects common movement of the steering member in response to steering at the helm.

Suitable actuatable steering means may be mechanical, electrical or hydraulic, or a combination of any two. In accordance with one embodiment of the invention, the actuatable steering means is a mechanical push-pull cable arrangement comprising a flexible outer sheath or cover and an inner core axially slidable in the sheath. The sheath protects the core, and also helps in directing the cable and in preventing the cable from coiling. If a mechanical cable is utilized, the cable is operably connected at one end to the power steering assist means, and at the opposite end to the propulsion unit. Steering actuation at the helm actuates or effects output at the power steering assist means and actuates the cable, more specifically the inner core, thereby effecting common movement of the steering member. Also, a plurality of steering cables may be used to provide output such as for a large engine or where two or more engines are used for the boat. Where desired, a hydraulic system may be utilized as an actuable steering means. Typically, a hydraulic system comprises a cylinder and piston arrangement operably connected with the power steering assist means to effect output, and means for pumping pressurized fluid to one end of the cylinder to actuate the piston in response to steering movement at the helm. Steering movement at the helm effects common movement at the steering member to pivot the propulsion unit about a vertical steering axis.

The hydraulic cylinder-piston assembly for the power steering assist means includes a valve control means normally biased to a closed position, and a hydraulic fluid source means for providing pressurized hydraulic fluid to the cylinder-piston assembly. The fluid source means comprises an accumulator means for delivering hydraulic fluid to the cylinder-piston assembly, and a reservoir means for accepting hydraulic fluid directed from the cylinder-piston assembly and passing the fluid to the accumulator. For power steering, the actuating means operably connected to the actuable input means, e.g., gear drive means, and to the valve control means will, upon steering movement, actuate the valve control means to open fluid communication and provide for delivery of pressurized fluid through the cylinder-piston arrangement from the fluid source means, thereby simultaneously providing output to actuate the actuable steering means to effect common movenent of the steering member. The actuating means selectively actuates the valve control means for a right turn direction or for a left turn direction, and this actuatable movement is preset so that it is substantially equal for both turn directions. In the preferred embodiment, the valve control means comprises two spaced apart valve housings with the valve or valves biased to a closed position, and the actuating means opens the valves for one valve housing only depending on the steering direction, thereby directing the flow of pressurized hydraulic fluid. Pressurized hydraulic fluid delivered to the cylinder-piston assembly reciprocates the piston, and associated means operably connected to the piston actuates the actuatable output means, e.g., output cable, to effect common movement of the steering member.

In the event of failure of the fluid source means or system which would result in a loss of pressurized fluid in the cylinder, second valve control means permits delivery of hydraulic fluid to either side of the piston of the cylinder-piston assembly. Steering actuation at the helm manually moves the piston, which creates a vacuum in the chamber. This vacuum draws oil into the chamber with the increasing volume through the second valve control means. Hydraulic fluid is drawn from the fluid source means, e.g. reservoir, through the second valve control means and into the cylinder chamber on either side of the piston (e.g., the upstroke side of the piston or on the downstroke side of the piston) in order to maintain hydraulic fluid in the chamber and on each side of the piston. When in a no-steering position or neutral position, this second valve control means of the cylinder-piston assembly is closed, and the system is hydraulically locked, that is, no oil can flow into or out of the cylinder chamber, and there is no feed-back to the steering wheel. In accordance with one embodiment of the invention, there is provided coupling means for operatively engaging the gear input means with the gear output means upon steering actuation to effect movement of the steering member.

The cylinder-piston assembly and fluid source means are supported by a suitable housing for mounting, and because the system is remote from the engine, the system can be mounted in a place which is protected from exposure to the elements and to physical abuse. Further, in accordance with a preferred embodiment, the actuating means includes suitable linking means operably connecting the gear drive means and the gear output means, which is free to reciprocate upon actuation of the steering means. A suitable ram extending from the piston in the cylinder-piston assembly is operably connected to the linking means and to the output gear means, which provides output to the actuatable steering means. Also, the actuating means, which reciprocates upon steering actuation, includes means to adjust the travel distance of the actuating means so as to control the valve opening and thereby allowing for a desired or necessary increased rate of steering.

DESCRIPTION OF THE DRAWINGS

FIG. 4 is a side elevational view of the power steering system of FIG. 3.

FIG. 7 is a diagramatic representation of the gear arrangement utilized in the structure of the present invention.

FIG. 7A is a cross-sectional view on line 7A—7A of FIG. 7.

FIG. 7B is a cross-sectional view on line 7B—7B of FIG. 7.

DETAILED DESCRIPTION AND PREFERRED EMBODIMENTS

Although the invention is described herein below with particular reference to the power steering system disclosed in copending application Ser. No. 08/012,552 (cited above), it should be understood that the invention is also applicable to other power steering systems utilizing a hydraulic cylinder-piston assembly, including the type described in U.S. Pat. No. 5,228,405 (cited above) and in copending application Ser. No. 08/422,893.

Figure 1:
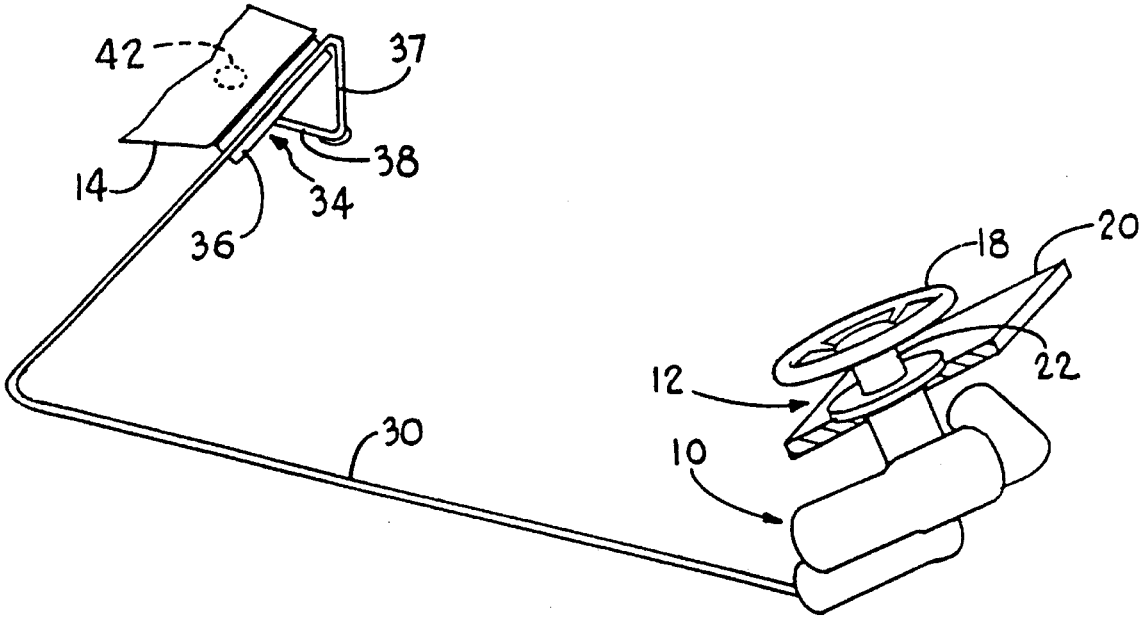
FIG. 1 is a schematic representation to show a steering arrangement utilizing the present invention for use in a marine vehicle.
Figure 2:
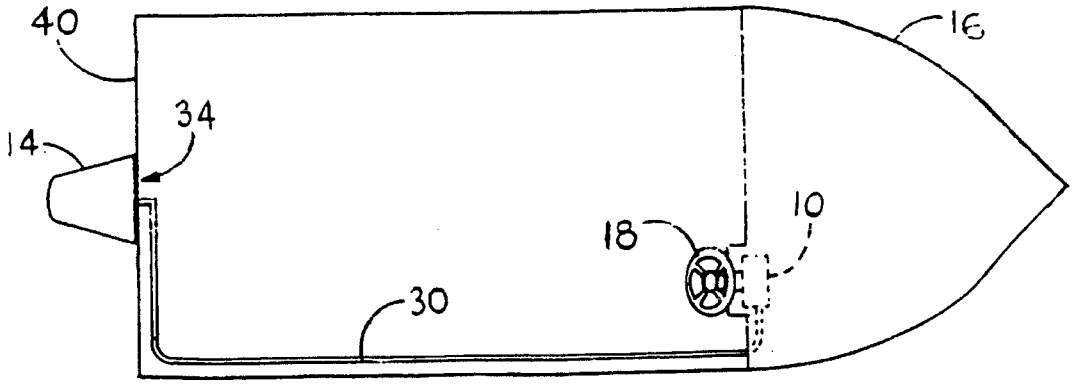
FIG. 2 is a diagramatic plan view of a boat utilizing the structure of the invention.

Referring to the drawings, wherein the same reference numerals refer to similar parts throughout the various views, there is shown diagramatically in FIGS. 1 and 2 a power steering system of the present invention as mounted on a boat. In accordance with the present invention, the power steering system includes a power steering assist means, indicated generally by the numeral 10, operably interposed between the steering helm 12 and the propulsion unit 14 and mounted remotely from the propulsion unit. It should be understood that the power steering assist means need not be physically positioned between the helm and the propulsion unit, but the power steering assist means is in-line in that it completes the actuatable connection between the helm and propulsion unit. Preferably, the power steering assist means 10 is mounted at or near the helm. As shown, the steering helm 12 is positioned at or near the fore of the boat hull 16, and typically includes a steering wheel 18 appropriately mounted in panel 20. Steering shaft 22 is secured at one end to wheel 18, and is rotatable upon rotation of the wheel. The shaft 22, having integrally formed end cap 23 extends from the steering wheel through mounting 24 and is operatively connected with input gear means indicated generally by the numeral 26 and described below in detail. This end of the shaft is connected with the input gear means for operative movement in response to rotation of the steering wheel. Thus, rotation of the wheel 18 in one direction or the other actuates the input gear drive means 26, which is operably connected to power steering assist means 10, comprising a hydraulic fluid pressure actuated means, described below in detail, and provides power steering assist in response to actuation of the gear drive means. It will be observed that this gear drive means accepts input from the steering helm, and transfers the input to the power steering assist means.

A second gear means or output gear means, indicated generally by the numeral 28 and described below in detail, is operably engagable with the power steering assist means 10 for operative movement in response to actuation of the power steering assist means. An actuatable steering means indicated generally at 30, preferably comprising a push-pull cable having an outer sheath or cover 32 and inner core 33 which is slidably movable relative to the outer sheath, is operably connected at one end to the gear output means for actuation in response to operative movement of the gear output means. It will be observed that the actuatable steering means 30 is at a position separate and removed from the input gear means 26, but operative movement of input gear means as a result of steering movement at the helm, actuates power steering assist means 10, which in turn operatively moves gear output means 28 thereby actuating the steering means 30. Thus, the actuatable steering cable accepts output from the power steering assist means, and transfers the output to the propulsion unit, or, more specifically to the steering member of the propulsion unit. The actuatable steering means 30 is actualably connected at its opposite end to steering member 34 of propulsion unit 14, which typically includes a tilt tube 36, steering link 37 and steering arm 38, and is mounted on transom 40 of boat hull 16 for pivotal movement about a vertical steering axis 42 (the steering axis envisioned as being substantially normal to the surface of the water). In this manner, actuation of the steering cable 30 effects steering movement of the propulsion unit.

The power steering assist means 10, which is mounted between the steering helm and propulsion unit and remotely from the propulsion unit, includes a hydraulic cylinder-piston assembly 44, having a valve control means indicated generally at numeral 46 (see FIGS. 3, 6, 8 and 9), and a fluid source means 48 spaced apart from and in fluid communication with said hydraulic assembly 44 for providing pressurized fluid to the hydraulic assembly. The steering assist means 10 is mounted preferably near or beneath the panel 20. (See FIGS. 1 and 3.) Tank member or reservoir 50, for holding hydraulic fluid, and pump 52, operated by motor 53, are disposed for fluid communication with said hydraulic cylinder-piston assembly 44 and fluid source means 48. An actuatable linkage means extending from the power steering assist means 10 and operably connected to the gear output means 28, operates in conjunction with and upon actuation of steering wheel 12 to effect steering movement of the propulsion unit. Thus, when the hydraulic cylinder-piston assembly 44 is actuated in response to steering movement at the helm, pressurized hydraulic fluid, (e.g., pressurized oil) flows through the hydraulic assembly 44 delivered from the fluid source means 48, as described below in detail. Torque from the propulsion unit 14 is overcome by the power steering assist means 10 thereby reducing the effort at the steering wheel to only the effort required to operate the hydraulic cylinder-piston assembly 44, which is independent of the torque generated by the propulsion unit.

As best seen in FIGS. 3–7, there is shown gear input means 26 operably connected to the steering helm 12 through the steering shaft 22 and to the power steering assist means 10. In a preferred embodiment, gear input means 26 comprises an actuator gear or driving gear 54 having a generally cylindrical configuration with a bore 55 for coaxial mounting on one end of output shaft 56. The opposed ends of actuator gear 54 are provided with spaced apart radial teeth sections 58 and 60, and an interjacent planar section 62 having a slot 64 for accommodating stop means 66 protruding from output shaft 56, for reasons explained below. End cap 23 is provided with a conventional key means (not shown) suitable for engaging with teeth section 58 so that rotation of the steering shaft 22 rotates actuator gear 54. The opposed end of actuator gear 54 having radial teeth section 60 meshes with input drive gear 68 disposed axially on input shaft 70 spaced from and substantially parallel to the output shaft 56. At the opposed end of input shaft 70 is input rack and pinion comprising elongated bar rack 74 having a substantially circular cross-section with a flattened rack surface and pinion gear 76 disposed in meshing relationship with bar rack 74. Thus, for this input assembly of gear drive means, actuator gear 54 is rotatably mounted on output shaft 56 and engaged with steering shaft 22 at the end opposed to the connection of the steering shaft to the steering wheel 18, and turning the wheel 18 rotates shaft 22 which in turn rotates actuator gear 54.

Input drive gear 68 is disposed in operative engagement with actuator gear 54, each gear having radial teeth for meshing relationship. It will be observed that rotation of actuator gear 54 in either a clockwise or counterclockwise direction rotates input drive gear 68 in the opposite direction. Input drive gear 68 is connected or affixed to rotatable input shaft 70 which extends to pinion gear 76, and is operative in response to rotation of drive gear 68. Elongated rack 74 is disposed in meshing relationship with pinion 76, and is protected by housing 78. Rack 74 is connected at one end to actuator bracket 80, as with bolt 81, and it is preferable that the engagement periphery of the rack 74 with pinion 76 extend less than the full length of the rack because of this connection. Actuator bracket 80 is operably connected to the hydraulic cylinder-piston assembly 44, thereby establishing an operable connection between the steering helm and the hydraulic assembly and the hydraulic assembly and actuable steering means, as described and explained below in greater detail.

Figure 3:
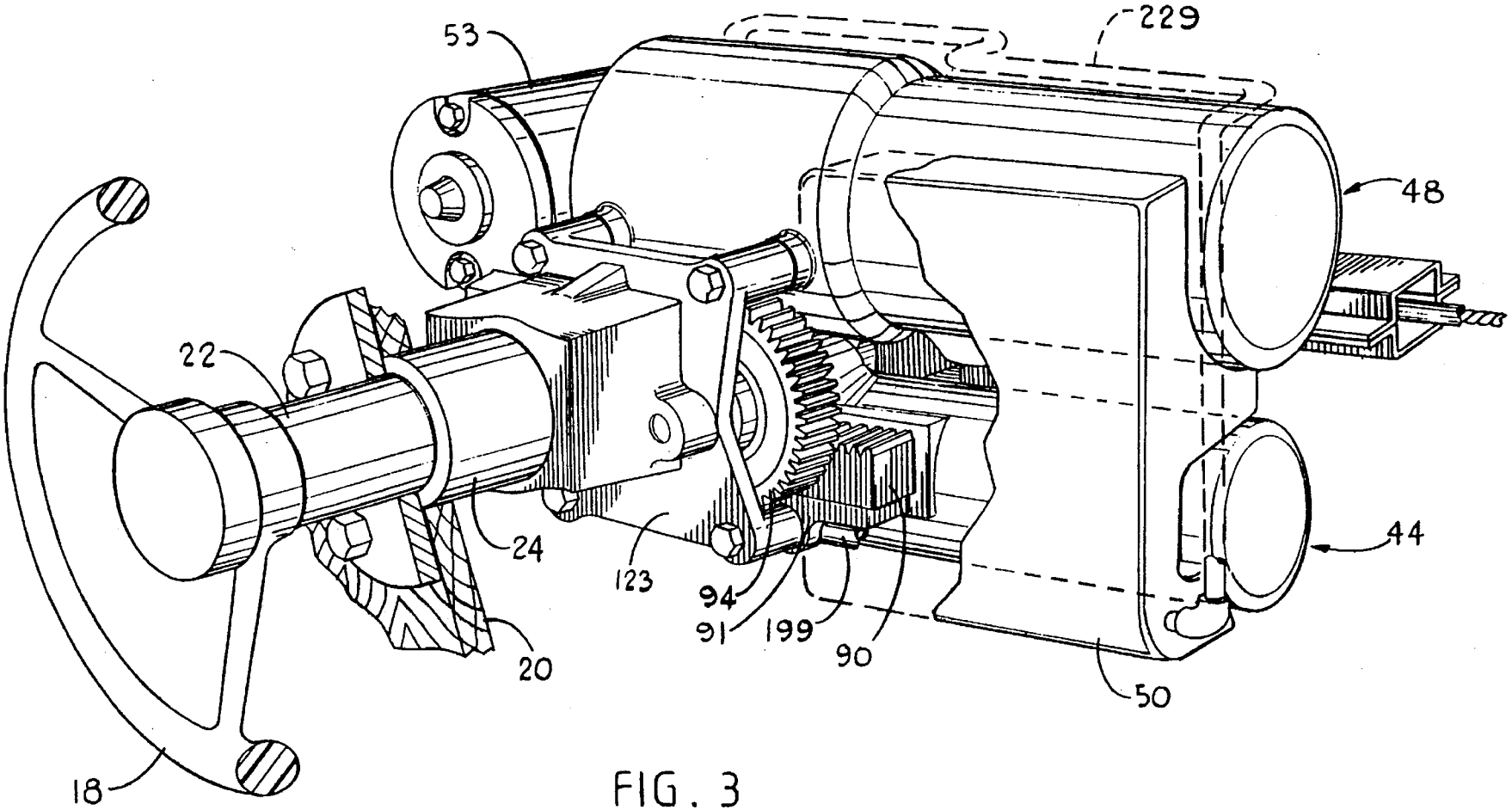
FIG. 3 is a perspective view of the power steering system of the present invention, with a portion broken away to better illustrate certain details.
Figure 5:
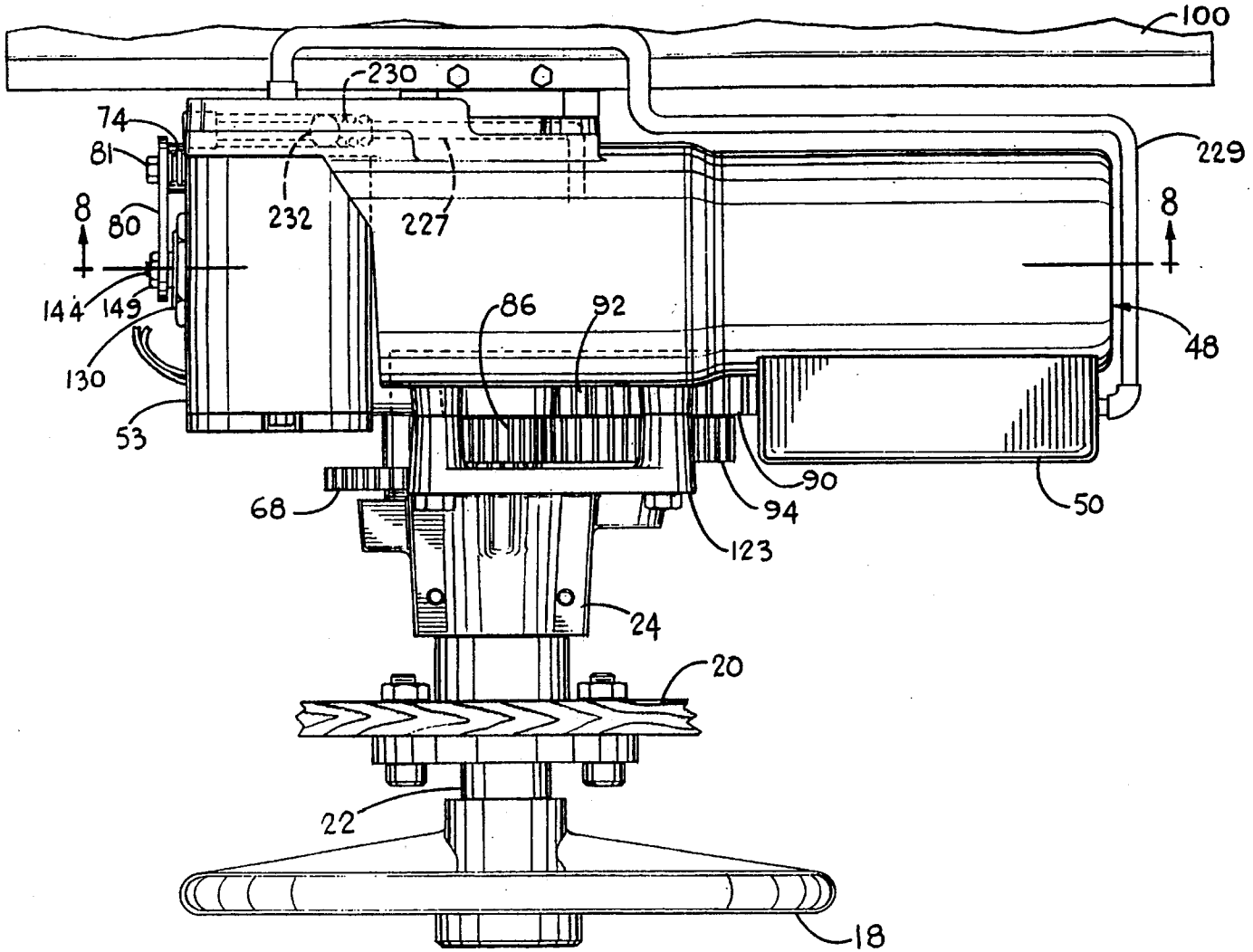
FIG. 5 is a plan view of the structure of FIG. 3.
Figure 6:
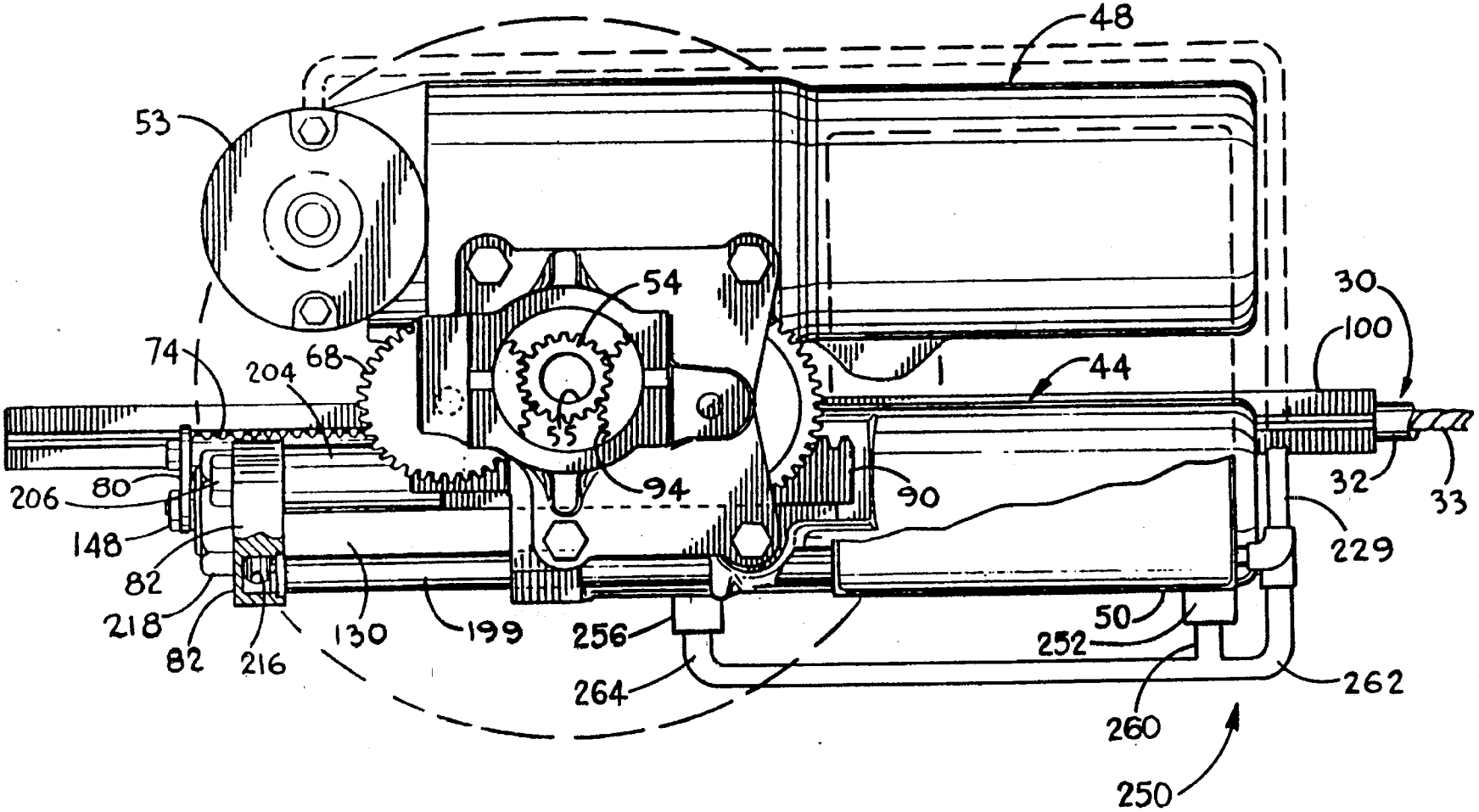
FIG. 6 is a front elevational view of the structure as shown in FIG. 5 with the steering wheel and steering shaft removed.

The reciprocal travel distance for actuator bracket 80 is predetermined or preset and this distance is short relative to the travel distance of the ram rod in the cylinder-piston assembly 44, as explained below, and therefore input bar rack 74 travels a corresponding distance when providing input or actuation to the actuator bracket. Reciprocal movement of the actuator bracket 80 actuates the valve control means 46 of the cylinder-piston assembly, including a reciprocating ram, and described below. As shown in the drawings (see FIGS. 4 and 11), output bracket 82 is operably connected to the ram of the cylinder-piston assembly 44 (described below), and to the gear output means 28. In a preferred embodiment, the gear output means comprises a first output rack and pinion indicated generally at 84 in operable engagement with an output shaft gear 86 which is operably connected to a second output rack and pinion indicated generally at 88. As best shown in FIGS. 3, 6, and 7, first output rack and pinion includes elongated bar rack 90 of substantially rectangular configuration, mounted for lateral movement on support 91, and is disposed for lateral movement upon corresponding reciprocal movement of the ram in cylinder-piston assembly 44 (described below). Pinion gear 92, which is disposed in meshing relationship with rack 90, and output gear 94, of larger diameter than gear 92, are coaxially mounted on shaft 96, so that upon lateral movement of rack 90, both gears 92 and 94 rotate together. Output shaft gear 86 is mounted or affixed near one end of output shaft 56 adjacent to actuator gear 54, and further output gear 94 is arranged in meshing relationship with output shaft gear 86. Thus, rotation of output gear 94 rotates output shaft gear 86, which in turn rotates output shaft 56.

Actuable steering means 30 is operably connected at one end to second output rack and pinion 88 in housing 100, comprising pinion gear 98 and an elongated rack 102 in meshing relationship with pinion 98. Thus, rotation of output shaft 56 in either a clockwise or counterclockwise direction moves the rack 102 in one direction or the other. Transverse movement of this rack actuates the steering means 30. In order that this second output rack 102 moves at a predetermined rate with respect to the first output rack 90, which is operably connected to the hydraulic cylinder-piston assembly 44 as described below, output gear 94 is in meshing relationship with output shaft gear 86. The output shaft 56, being driven by output gear 94, is operably connected to pinion 98 disposed in meshing relationship with rack 102, and therefore rack 102 moves in the same general direction as the direction of rotation of pinion 98, i.e., clockwise rotation of pinion 98 moves rack 102 to the right. It thus will be observed both first and second rack and pinion assemblies 84 and 88 operate substantially concomitantly, and that output racks 90 and 102 move at substantially the same ratio.

Where desired, the power steering system of the invention can incorporate more than one output rack and pinion 88. Hence, for a boat having two propulsion units, or for a boat having two steering cables, there is provided two output rack and pinions assemblies 88 and 88', as shown in FIGS. 4 and 7B, and actuatable steering means 30 and 30' (e.g., steering cables) are connected to the rack and pinion assemblies. Thus, there is shown in FIG. 7B, pinion gear 98 mounted or affixed to the end of output shaft 56, and a second pinion gear 106 mounted in meshing relationship with gear 98. Elongated bar rack shown schematically as 107 is mounted transversely to the axis of gear 106 and in meshing relationshp thereto. Thus, rotation of the output shaft rotates pinion 98, causing lateral translation of rack 102 and rotation of pinion 106 which moves rack 107. Although rotation of pinions 98 and 106 will be in opposite directions, the lateral movement of racks 102 and 107 will be in the same direction. Actuation of the two steering means 30 and 30' then will be coincidental.

The hydraulic cylinder-piston assembly 44 includes a cylinder 108 having a bore 110 for accomodating piston 112 mounted for reciprocating movement therein and thereby defining or forming opposed first and second chambers 122 and 140, respectively. (See FIGS. 8 and 9.) The piston 112 includes end cap 114 forming the piston head and opposed to the ram end and is affixed to the piston and provided with openings 116, and an integrally formed plug 118 extending laterally from the end cap, is spaced from the cylinder end wall 120 thereby defining first chamber 122 at one end of the cylinder for accommodating a hydraulic fluid, e.g. oil. At the opposed end of cylinder 108 is housing 123 for supporting the hydraulic cylinder-piston assembly and the fluid source means 48, and further includes spaced apart, transverse bores 124 and 125, to receive output shaft 56 and shaft 70, respectively.

Piston 112 is mounted for reciprocative movement in the bore 110 of cylinder 108, and is provided with appropriate sealing gaskets and bearings (not shown) to prevent fluid leakage along the outside surface of the piston. Further, piston 112 is provided with threaded annular recess 126, and threaded terminus 128 of tubular ram rod 130 is threadedly engaged with recess 126. Ram rod 130, concentrically arranged with and coaxially disposed along the longitudinal axis of cylinder 108 and spaced inwardly therefrom, extends longitudinally from piston 112 outwardly from the terminus of cylinder 108, and is slidably retained by housing 123 and fixedly connected at its terminus to actuator bracket 82. The ram rod 130 has a plurality of spaced apertures 132, for reasons more fully explained below, and further is provided with annular reduced portion of smaller diameter than the head diameter, and this reduced portion has a lateral or inwardly extending annular shoulder 134.

Ram rod 130 is substantially concentric with cylinder 108 which accommodates piston 112, thereby defining annular channel or second chamber 140. It will be observed that second chamber 140 is in fluid communication with valve control means 46 through apertures 132. Annular ram rod 130 has an axial passageway or channel 142 relative to the longitudinal axis, and is in fluid communication with the valve control means 46, as described below.

Valve control means 46 includes reciprocating piston 112 mounted for reciprocal movement in bore 110 of cylinder 108. Actuator rod 144, having a reduced section 145 with annular shoulder 146, extends longitudinally from the valve control means 46 through channel 142, and is supported at the opposite end distal from the piston by bearing 147. The reduced section 145 extends through the bearing 147, and rod 144 is operably connected at threaded end 148 to actuator bracket 80 by means of adustment nut 149 (described in more detail below)- The opposite threaded end 150 is threadedly engaged to valve control means 46. The piston end of ram rod 130 of enlarged diameter is provided with a longitudinal bore 152 which is substantially coaxial with channel 42, and extends from the interior facing of end cap 114 to define spacing or opening 154 and terminates outwardly therefrom at shoulder 134. Annular ball actuator 158, having an open-ended longitudinal bore 160, is mounted in bore 152 for reciprocative movement axially relative to the ram rod 130. The opposite end of ball actuator 158, extending outwardly into opening 156, is internally threaded at 162 for threaded engagement with threaded section 150 of actuator rod 144. Ball actuator 158 is provided with at least one and preferably a plurality of apertures 164 disposed inwardly (in the direction of shoulder 134) from threaded section 162 for establishing fluid communication between channel 142 and bore 160. Interposed between the apertures 164 and the terminus at opening 154 are spaced apart annular flanges 166 and 168, which extend transversely outwardly from the cylindrical wall of ball actuator 158 into chambers 170 and 172, respectively. Threaded end 150 of actuator rod 144 is externally threaded to threadedly engage threaded section 162 of ball actuator 158. Because actuator rod 144 is operably connected to ball actuator 158, when reciprocal movement of actuator rod 144 is caused by movement of actuator bracket 80, ball actuator 158 is moved axially relative to ram rod 130.

Figure 9:
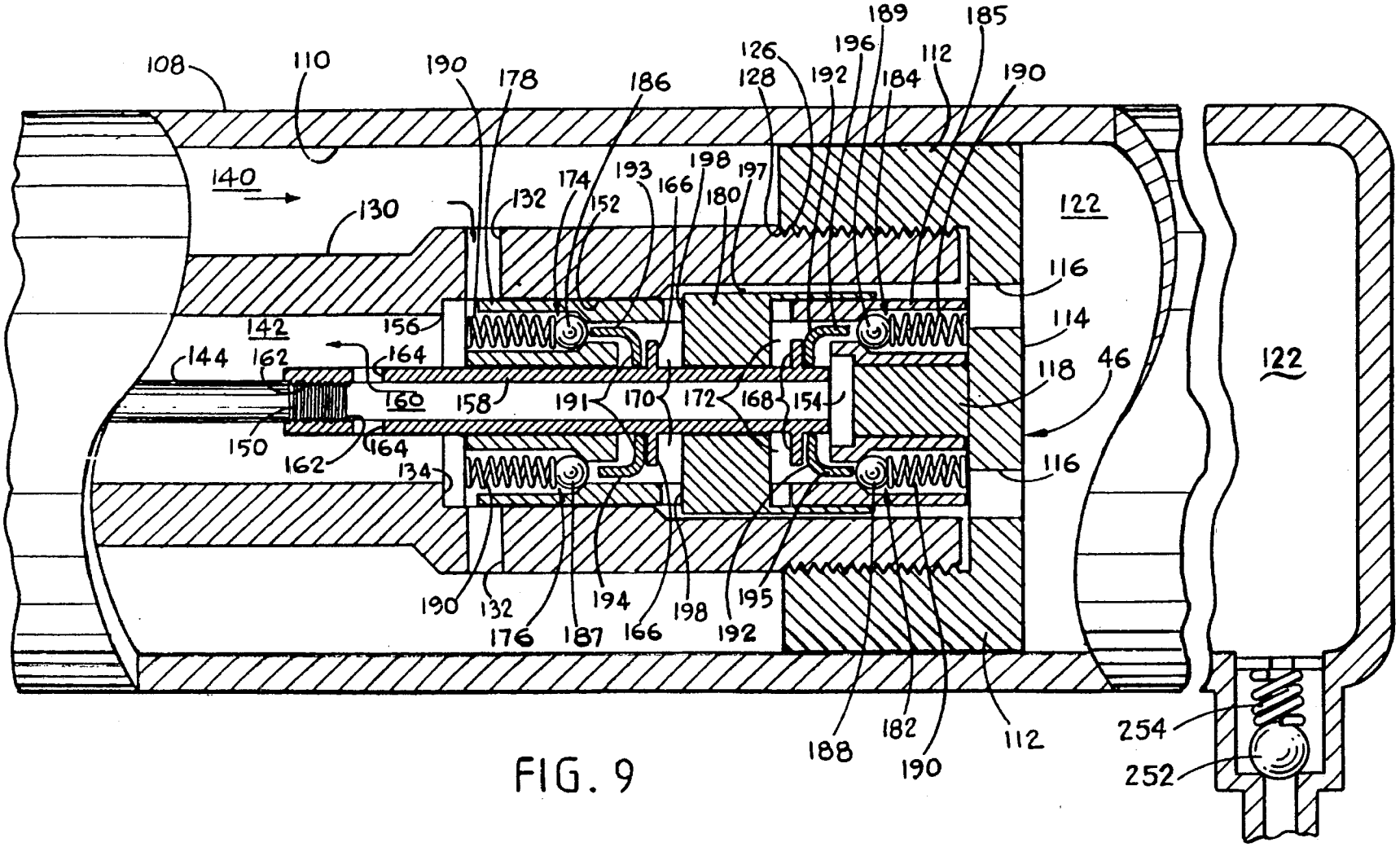
FIG. 9 is a fragmentary cross-sectional view showing in greater detail the first and second valve control means.
Figure 10:
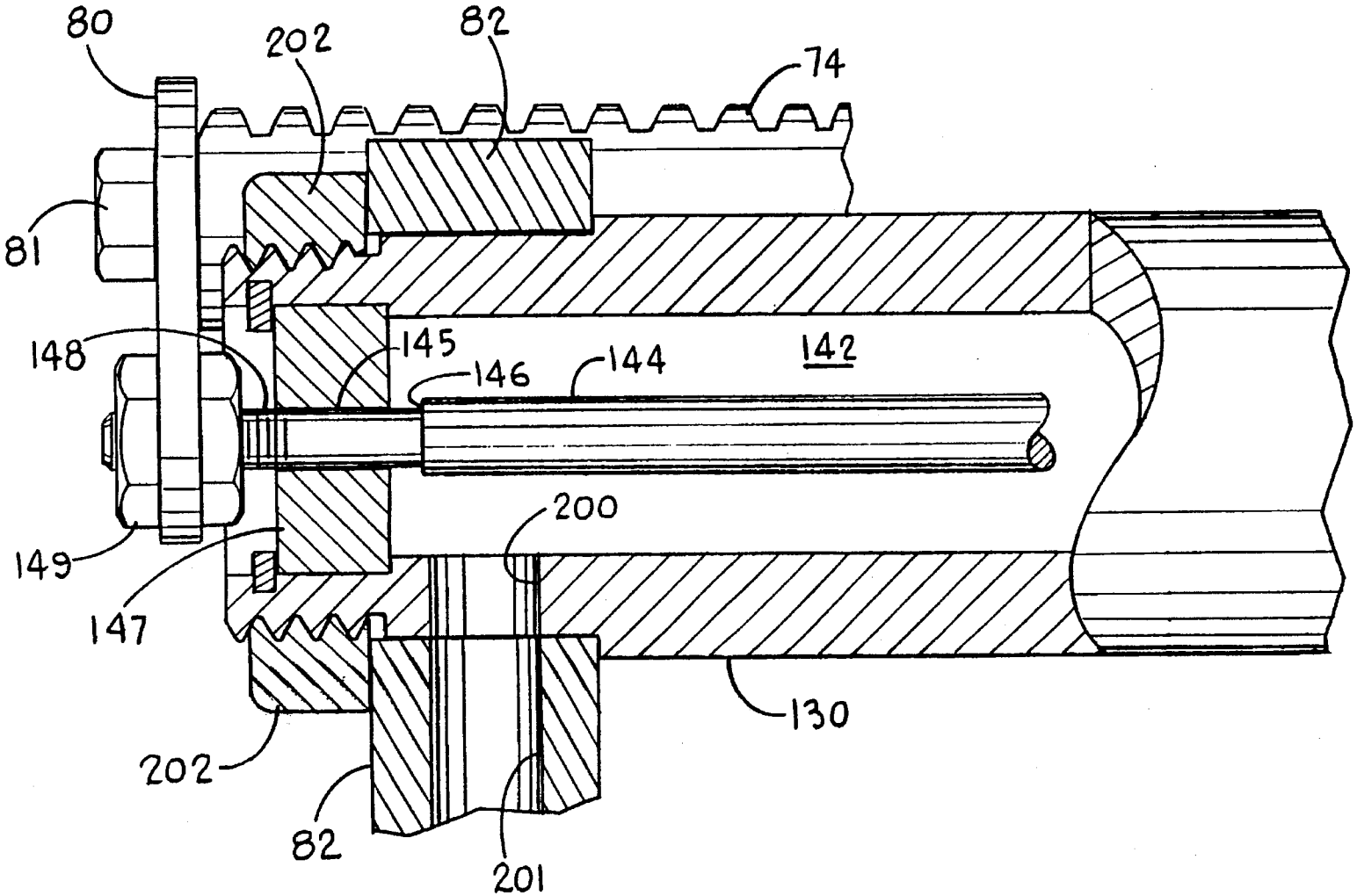
FIG. 10 is a fragmentary cross-sectional view showing in greater detail the actuating means for the power steering assist means.

As more clearly shown in FIG. 9, valve control means 46 further includes (a) ball check valves 174 and 176 disposed in valve body 178 for controlling the flow of pressurized hydraulic fluid delivered from the fluid source means 48 through a first fluid communication means to chamber 122 (described below), and, separated by divider 180, and (b) ball check valves 182 and 184 disposed in valve body 185 for controlling the flow of pressurized hydraulic fluid from chamber 122 through a second fluid communication means (described below). In this manner, the flow of hydraulic fluid, e.g. oil, is essentially in one direction only. As shown in the illustrated construction, each ball check valve has a check ball shown as check balls 186, 187, 188 and 189, and when in a no steering change position, each ball check valve is maintained in a closed position by suitable bias means 190, such as a coiled spring, which biases each ball against a cooperating seat so as to prevent the passage of oil through the ball check valve. In this position, the valve control means 46 is locked and cannot be moved. Ball actuator pins 191 and 192, preferably formed as an annular member or ring insertable on the ball actuator, has one or more transverse flanges or bosses 193, 194, 195 and 196 extending from the outer peripheral edge of the ring with the terminus spaced from the check ball when in a no steering change position. For each check ball there is a flange or boss member, and upon steering movement to the left or right, a boss is brought into contact with a check ball so as to unseat the ball. Upon axial movement of the ball actuator to the left or to the right, flange 166 or 168 engages an actuator pin 191 or 192 and forces a boss into engagement with with a check ball to move the check ball from its seat, thereby allowing for the flow of pressurized hydraulic fluid, e.g. oil, through the valve assembly, as explained below. Thus, it will be observed from FIG. 9 that when ball actuator 158 is moved to the left as by a left steering motion, pin 191 is moved to the left so that the bosses 193 and 194 engage check balls 186 and 187, thereby opening ball check valves 174, 176. Conversely, when ball actuator 158 is moved to the right as by a right steering motion, pin 192 is moved to the right so that the bosses 195 and 196 engage check ball 188 and 189, thereby opening ball check valves 182, 184. In a preferred embodiment, the boss 193 for pin 191 is longer than boss 194. As a consequence, upon axial movement of ball actuator 158, check ball 186 will be raised from its seat prior to, and without unseating check ball 187, and check ball 187 will be unseated to provide for an increased flow of pressurized hydraulic fluid for a left turn position only to increase the rate of turn, if required, of the actuation of the power steering assist system. Similarly, boss 195 for pin 192 is longer than boss 196, and therefore check ball 188 is opened first, and check ball 189 is opened to increase the rate of turn for a right turn.

Ram rod 130 includes annular channel 197 extending between ball check valves 174 and 176 and orifice 116 for supplying pressurized hydraulic fluid, e.g. oil, to chamber 122. Thus, annular channel 140 of cylinder 108 is in fluid communication with the valve body via ball check valves 174 and 176 through apertures 132 in the side wall of ram rod 130. When one or both of these valves is opened upon actuation of ball actuator 158 (e.g., steering is to the left, and therefore the ball actuator is reciprocated to the left as viewed in FIG. 9), fluid communication continues from chamber 170 via orifice or opening 198 to annular channel 197 extending longitudinally through ram rod 130, and then to orifice 116 in the end cap 114 of piston 112 and opening to chamber 122. It will be observed that pressurized fluid entering chamber 122 forces piston 112 to the left. In this manner, hydraulic fluid such as oil delivered from fluid source means 48 flows through the piston and into chamber 122, thereby completing a first fluid communication means between the fluid source means and chamber 122. The pressurized fluid flowing from chamber 122 and returning to fluid source means 48 flows through the ram rod 130 in an essentially different flow path. End cap orifice 116 opens in part to ball check valves 182 and 184, which in turn open to chamber 172 and then to opening 154 fluid communicating with bore 160 which is in fluid communication with axial channel 142 through apertures 164. Thus, when one or both ball check valves 182, 184 is opened upon actuation of ball actuator 158 in the opposite direction from that described above (e.g., to the right), communication means for permitting the flow of hydraulic fluid is established between chamber 122, through ball check valves 182 and 184, opening to bore 160 of the ball actuator, which in turn opens to axial channel 142. The opposite end of axial channel 142 is in fluid communication with return line 190 via aligned passageways 200 and 201 in ram rod 130 and output bracket 82, respectively, and terminating at oil tank 50, and from the tank to fluid source means 48, as explained below in detail. The depletion of hydraulic fluid in chamber 122 causes the piston 112, and consequently the ram rod 130, to move to the right, thereby completing a second fluid communication means between chamber 122 and fluid source means 48.

As explained above, ram rod 130, disposed concentrically with and inwardly spaced from cylinder 108, extends from piston 112 where it is fixedly attached at the ram end, and is slidably retained by bore 209 in housing 123 having a suitable bearing surface to accommodate the reciprocating rod. At its opposite end, the ram rod is fixedly attached to output bracket 82 as by threaded engagement with nut 202. Further, actuator bracket 80 is operably connected to actuator rod 144 which, in turn, is operably connected at its opposed end to ball actuator 158, such that upon steering actuation at the helm to actuate the gear assemblies, these elements (i.e., actuator rod, actuator bracket and ball actuator) reciprocate or move in unison thereby opening one or the other of the ball check valves 174, 176 or 182, 184 to permit the flow of hydraulic fluid through the cylinder-piston assembly 44.

In a preferred embodiment as shown in FIGS. 7, 8, 9 and 10, adjustment nut 149 is screw threaded onto the threaded section 148 of actuator rod 144 at the opposed surfaces of the actuator bracket 80. The length of engagement, which in actual practice can vary for each power steering apparatus because of machine tolerances, provides for a predetermined travel distance for the actuator bracket 80. This travel distance is equal to a full unseating of both ball check valves 182, 184 (for a right turn), at which point the side wall of slot 64 in planar section 62 engages stop means 66, thereby actuating output shaft 56. Rotation of shaft 56, which is in operably engagement with gear output means 28, will cause manual activation of ram rod 130 in the direction and rate of travel relative to actuator bracket 80. Thus, for a no steering change position, adjustment nut 149 is set to a predetermined position and locked in place. When steering is to the right, actuator rod 144 begins moving to the right to open one or both ball check valves 182, 184 and permit the flow of hydraulic fluid, e.g. oil, through valve control means 46 via the second fluid communication means described above, and, if the turn speed is increased, will move the complete travel distance until the stop means 66 abuts the wall of slot 64, thereby stopping any further movement of the actuator rod 144 and causing manual steering. Conversely, when steering is to the left, actuator rod 144 begins moving to the left to open one or both ball check valves 174, 176 to permit the flow of hydraulic fluid into valve control means 46 via the first fluid communication means described above, and, if the turn speed is increased, will move the complete travel distance until stop means 66 abuts the opposite wall of slot 64, thereby stopping any further movement of the actuator rod. At this point, slot 66 in planar section of actuator gear 54 engages stop means 66 causing manual steering.

Figure 11:
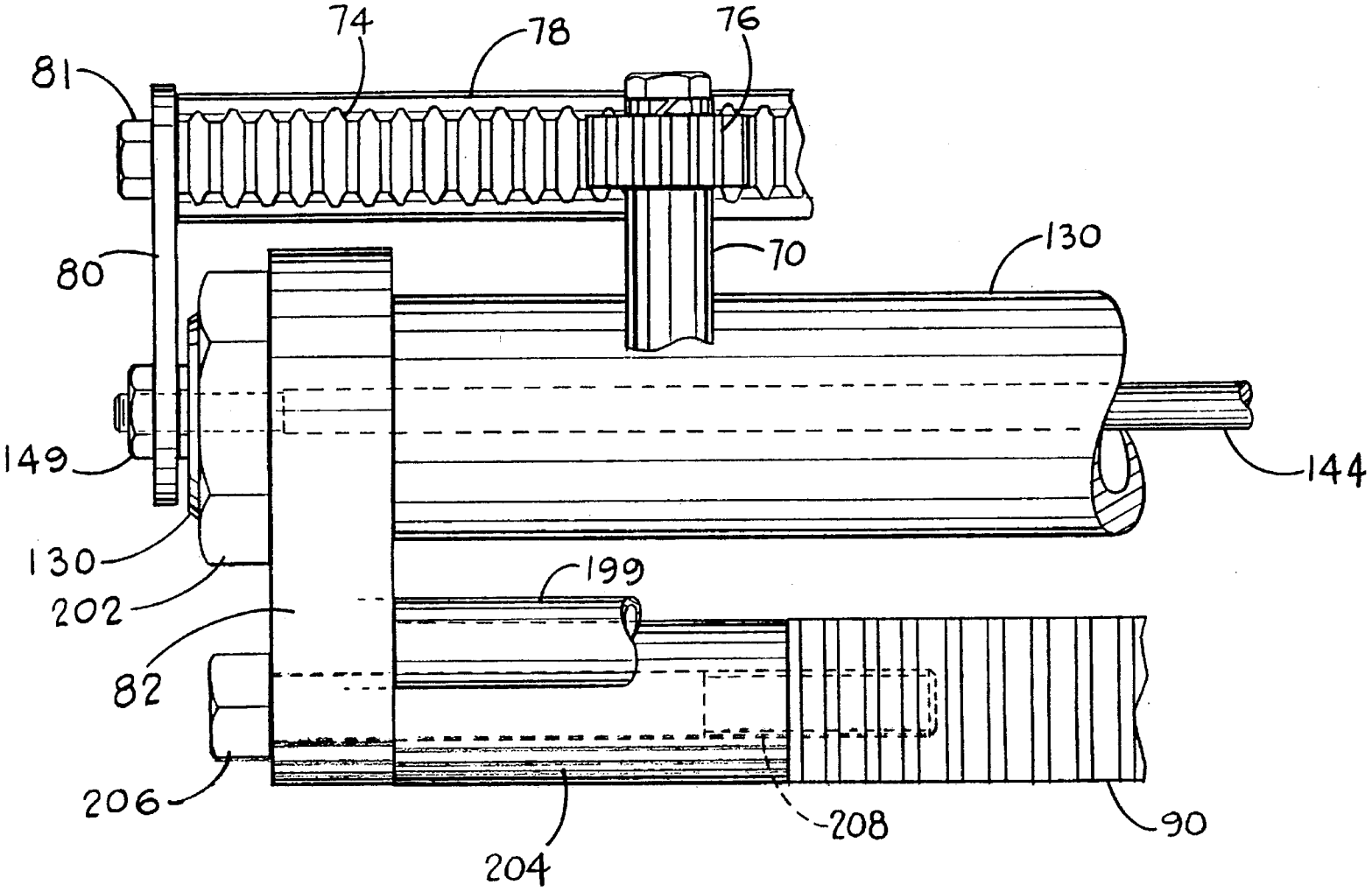
FIG. 11 is a diagramatic representation showing in more detail the actuating means in operable connection with the gear arrangement.

Output bracket member 82 is operably connected to annular ram rod 130, and reciprocates in unison or in common with the reciprocative movement of the ram rod 130. (See FIGS. 6, 8, and 11.) Further, output bracket 82 is also operably connected to bar rack 90 (of first output rack and pinion 84), which therefore will move laterally upon reciprocal movement of the ram rod. As best shown in FIG. 11, it is preferable to utilize a spacer 204 between the bracket member 82 and gear rack 90, which members are then connected by such means as bolt 206, having a threaded section 208, extending longitudinally through the spacer and into a threaded bore 209 in the gear rack. As explained above, actuating first output rack and pinion 84 rotates output shaft gear 86 which in turn effects actuation of second output rack and pinion 88. The bar rack 102 is adapted to receive one end of the inner core 33 of steering means 30 for axial movement, and said end of core 33 is operably connected to the rack 102 so as to reciprocate in common with the lateral movement of the rack. The opposite end of the inner core 33 is operably connected to steering member 34 of the propulsion unit 14. It thus will be observed that actuation of ram rod 130 actually reciprocates output bracket 82, and by means of gear output assembly 28, actuates steering means 30, thereby effecting common movement of the steering member 34 in response to the steering actuation at the helm 12 to pivot the propulsion unit 14 about the steering axis 42.

In a preferred embodiment, the rate of travel for the ram rod 130 and the first output rack 90 are substantially equal, that is, are in a ratio of about 1:1. Output gear 94, however, is larger in diameter than pinion gear 92 and also output shaft gear 86, and the linear travel ratio of the second output rack 102 to the first output rack 90 is greater than 1, and preferably this ratio is about 2:1. By reason of this travel relationship between racks, it is possible to reduce the overall size of the complete assembly.

Figure 8:
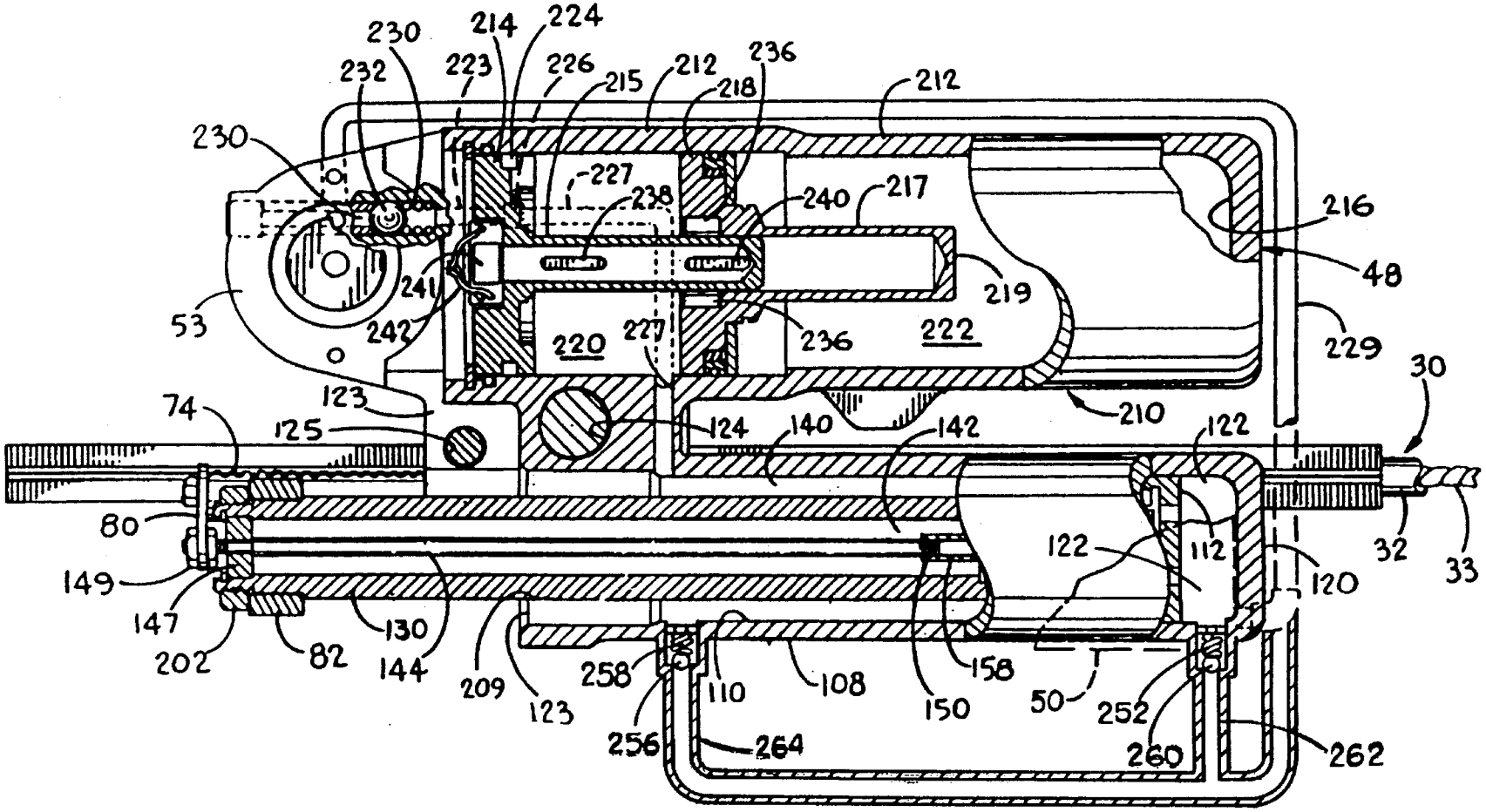
FIG. 8 is a cross-sectional side view of the structure of FIG. 6.

Referring now in particular to FIG. 8, there is shown fluid source means 48 having a cylinder-piston accumulator 210 comprising cylinder 212 closed at one end with wall 216 and at the opposite end by end cap 214. Piston 218 is mounted for reciprocal movement in cylinder 212 which divides the cylinder into chambers 220 and 222. Tubular member 215 extends axially from end cap 214, and coaxial tubular extension 217 of piston 218, projecting into chamber 222 and having a closed end 219, is adapted for slidably receiving member 215, and this reciprocal slidable movement on member 215 inhibits wobble of the piston as it reciprocates in the cylinder chamber. Housing 123 is provided with a fluid passageway 223 that opens to circumferential passageway 224 in cap 214 having slotted peripheral opening 226 to provide fluid communication with chamber 220. A second fluid passageway or bore 227 in housing 123 establishes fluid communication with annular passageway 140 in cylinder 108, thereby completing first fluid communication means extending from chamber 220 in fluid source means 48 to chamber 122 in hydraulic cylinder-piston assembly 44. Pump 52 is disposed adjacent the accumulator 210, and the pump is operated by electric motor 53 having a suitable power source such as a battery or by generator (not shown). The pump receives hydraulic fluid via second return line 229, and cooperably with tank member 50 and pump 52 provide a reservoir means for the hydraulic fluid. Conduit 230, having check valve 232, leads from the pump to the cylinder chamber 220 in the cylinder-piston accumulator 210. Hydraulic fluid, e.g. oil, is delivered to the pump via return line 229. The check valve 232, which prevents hydraulic fluid from returning to the pump, that is fluid flows in one direction only from the pump to the cylinder chamber 220, is normally closed. Piston 218 moves reciprocally within cylinder 212 in response to hydraulic fluid entering chamber 220 through conduit 230 or leaving chamber 220 through passageway 227. Piston 218 is biased to a fluid delivery position by pressurized gas contained in the second chamber 222, such gas being typically nitrogen under a pressure of from about 800 to 1200 pounds per square inch. Thus, in the illustrated emodiment, hydraulic fluid is forced from chamber 220 by the pressure exerted on the piston by the gas in chamber 222 as by a left or right turn thereby actuating the actuator rod 144 to open one or both ball control valves. When ball control valves 174, 176 are opened, the pressurized hydraulic fluid passes from chamber 220 to chamber 122 via the first fluid communication means comprising passageway 227, annular channel 140, apertures 132, ball check valves 174, 176, opening 198, annular channel 197, and aperture 116. Conversely, when ball check valves 182, 184 are opened, pressurized hydraulic fluid passes from chamber 122 and is returned to tank 50 via conduit 199, and then to the pump 52 via return line 229. When hydraulic fluid is pumped into chamber 220, piston 218 moves against the pressurized gas in chamber 222. This second fluid communication means comprises aperture 116, ball check valves 182, 184, opening 154, bore 160, aperture 164, axial channel 142, through aperture 200, through channel 201 in output bracket 82, and then to return line 199, tank 50, and then second return line 229 to pump 52.

A suitable switch means, which are of conventional construction and well known in the art, is preset to operate the motor 53 for pumping the hydraulic fluid, e.g. oil, through check valve 232 into chamber 220. When fluid is pumped into chamber 220, piston 218 is moved against the pressurized gas in chamber 222. A suitable switch means comprises a magnetic ring 236 carried by piston 218 and sensors 238 and 240 connected to a solenoid 241 wired to a power source (not shown) by wires 242. As the piston reciprocates to predetermined positions, magnetic ring 236 trips the sensors 238 and 240 to start or stop the motor 53 for pumping hydraulic fluid such as oil. In the illustrated embodiment as shown in FIG. 8, the piston 218 is essentially to the right of the midpoint of its travel. As hydraulic fluid in chamber 220 is depleted and the piston 218 moves to the left, magnetic ring 236 trips sensor 238 to start the motor. Fluid then is pumped into chamber 220 thereby moving piston 218 against the gas pressure until magnetic ring trips sensor 240 and turns off the motor 53.

In accordance with the present invention, there is provided a second valve control means, indicated generally by the numeral 250, for controlling the flow of hydraulic fluid from the fluid source means, e.g. reservoir, to the cylinder-piston assembly 44 in the event of failure of the power steering system. (See FIGS. 6, 8 and 9.) The valve control means includes a first check valve 252, normally biased to a closed position by coiled spring 254, for controlling flow of hydraulic fluid to first chamber 122 of the cylinder-piston assembly, and second check valve 256, normally biased to a closed polstion by coiled spring 258, for controlling flow of hydraulic fluid to second chamber 140 of the cylinder-piston assembly. It will be observed that when the power steering system is operational, or if a failure in the system but in a neutral or no-steering postion, the check valves 252 and 256 are closed to prevent the flow of hydraulic fluid into the chambers 122 or 140. Valve means 252 is in fluid communication with reservoir 50 via lines 260 and 262, and valve means 256 is in fluid communication with reservoir 50 via lines 264 and 262. Thus, when either valve is opened (e.g., valve lifted or removed from its seat), as explained below, communication is established between the fluid source means and one or the other of chamber 122 or chamber 140, thereby permitting the flow of hydraulic fluid through a valve and into a chamber.

In operation, which is described as using oil as the pressurized hydraulic fluid, the power assist steering means will operate in response to the steering movement at the helm by the operator. Assuming first that steering is to be to the left, that is the steering wheel is central and the propulsion unit is in a no-turn change position and the wheel is turned for a left turn movement, the helm actuates the gear input means 26, as explained above. The power steering assist means 10, which is operably connected to the gear output means 28 through the output bracket 82, is actuated upon movement of actuator bracket 80 to the left.

Flange 166, depending from the ball actuator 158, is positioned such that upon reciprocal movement contacts or abuts acutautor pin 191 and thereby forces open valves 174, 176 by unseating check balls 186 and 187 normally biased to a closed position by springs 190. Movement to the left by acutator bracket 80 relative to the output bracket 82 moves actuator rod 144 to the left thereby forcing the boss of ball actuator pin 191 to the left and against the ball valves. In the preferred embodiment, boss 193 is longer than boss 194, and initially check ball 186 only is unseated from its cooperating valve seat. The opening of valve 174 allows pressurized oil to flow from chamber 220 through the first fluid communication means comprising passageway 227 opening to annular channel 140, through apertures 132 and ball check valve 174, through opening 198, then to a second annular channel 197, and through apertures 116 and into chamber 122. Thus, the pressurized oil entering chamber 122 exerts a pressure on the piston 112 thereby moving it to the left along with ram rod 130 and output bracket 82. If the actuator bracket 80 is kept in the same position relative to output bracket 82, the steering rate will remain constant. If the steering rate has to be increased, the actuator bracket 80 will move a still greater distance to the left relative to the output bracket 82. This reciprocative movement of the actuator bracket will move check ball 186 further from its seat to permit an increase in the flow of oil from chamber 220 thereby increasing the steering rate. If the rate is still insufficient, the actuator bracket 80 is moved further to the left relative to the output bracket, which further actuates the actuator rod 144 and moves ball actuator further to the left. This movement brings boss 194, the shorter boss, into contact with check ball 187 to unseat the check ball and open the valve 176. With both valves open, the flow of pressurized oil from chamber 220 through the first fluid communication means into chamber 122 is increased. If the relative position of actuator bracket 80 to output bracket 82 is returned to its original position, check balls 186 and 187 are returned to their respective seats by reason of spring means 190 thereby blocking the flow of oil and stopping the steering movement.

When oil is delivered to chamber 122 from chamber 220 of the fluid source means 48, piston 112 is moved to the left. Thus, when the valves 174, 176 have been opened by a steering actuation, the force exerted on piston 218 by the pressurized gas in chamber 222 moves piston 218 to the left and thereby drives oil from chamber 220 to chamber 122 via the first fluid communication means. When the piston 218 reaches a predetermined position the magnetic ring 236 trips sensor 238, which turns on the motor 53 and starts the pump 52 to pump oil into chamber 220 via check valve 232. As the oil is pumped, additional oil enters the pump reservoir through the inlet line 229 from the oil tank 50. Oil entering chamber 220 moves the piston 218 to the right against the gas pressure in chamber 222. The check valve prevents oil from returning to the pump. When the piston 218 reaches a predetermined position, the magnetic ring trips sensor 240, which turns off the motor.

In the event of a failure, such as a battery failure or a motor failure, and the power steering assist means ceases to operate as described above, any continued steering will force the oil from the cylinder-piston assembly, in the absence of the second valve control means. Manual steering is possible, but there will be feed-back to the steering helm or wheel, thereby creating a steering problem and a potentially dangerous condition. This invention maintains anti-feed back by establishing fluid communication between the fluid source means and the cylinder-piston assembly via the second valve control means. Assume a failure, and assume further that steering is to be to the left, actuator bracket 80 is moved the predetermined distance, and ram rod 130 moves to the left, thereby opening valves 174 and 176 as explained above. Hydraulic fluid then will flow from the second chamber 140 through the valve body 46 via the check valves 174 and 176 and into chamber 122, as described above. Because chamber 122 is larger than chamber 140, first valve means 252 is opened by reason of a pressure drop (vacuum) created in chamber 122, and oil is drawn from the reservoir 50 through check valve 252 via lines 260 and 262 to chamber 122, thereby maintaining chamber 122 full of oil. If ram rod 130 is returned to its neutral position, check valves 174 and 176 are returned to their respective seat, and no oil can flow in or out of the cylinder. Thus, anti-feed back is maintained notwithstanding the failure in the power steering system, and the cylinder-piston assembly is maintained full of fluid during manual steering.

Similarly, if steering is to the right, the actuator bracket 80 moves the predetermined distance, and ram rod 130 is manually moved to the right which forces oil from chamber 122, through check valves 182 and 184, and into chamber 142. Oil then passes through passageways 200 and 201, and then to return line 199 leading to the tank or reservoir 50. Simultaneously, oil is drawn from the reservoir 50, through check valve 256 via lines 262 and 264, and into chamber 140 maintaining this chamber full of oil. Again, when the steering is returned to a neutral position, check valve 182 and 184 are closed, and the cylinder is hyraulically locked.

The foregoing detailed description has been given for clearness of understanding only, and no unnecessary limitations should be understood therefrom, as modifications will be obvious to those skilled in the art.

What is claimed is:

1. In a power steering system for a marine vehicle having a propulsion unit pivotal about a steering axis, and including an operator actuable steering helm and a steering member connected to said propulsion unit, which comprises: power steering assist means including a hydraulic fluid cylinder-piston assembly having a reciprocally mounted piston thereby defining a chamber to either side of said piston to accommodate hydraulic fluid, and actuated in response to steering actuation at said steering helm; hydraulic fluid source means for delivery of pressurized hydraulic fluid to said cylinder-piston assembly; first valve means disposed in said cylinder-piston assembly biased to a closed position for a no steering change position and adapted to establish fluid communication between said cylinder-piston assembly and said fluid source means; means to selectively actuate said first valve means to establish said fluid communication upon steering actuation; actuatable input means to effect actuating input to said power steering assist means upon actuation at said steering helm; actuatable output means to effect common movement of said steering member in response to steering actuation of said steering helm to pivot said propulsion unit about said steering axis; and means for maintaining anti-feed back upon a failure in the fluid source means including second valve means to establish fluid communication between said fluid source means and said chamber to either side of said piston thereby maintaining said chamber substantially full of hydraulic fluid.

2. A power steering system according to claim 1 wherein said second valve means comprises a first check valve to permit flow of fluid to said chamber on the up-stroke side of said piston, and a second check valve to permit flow of fluid to said chamber on the down-stroke side of said piston.

3. A power steering system according to claim 1 or claim 2 and further including a coupling means for operatively engaging said actuatable input means with said actuatable output means upon manual steering.

4. A power steering system for a marine vehicle having a propulsion unit pivotal about a steering axis, steering means for applying torque to said propulsion unit to effect steering movement thereof about said steering axis and including an operator actuable steering helm and a steering member connected to said propulsion unit: which comprises, power steering assist means having a reciprocating mechanical output force and operably connected to, and operably interposed between, said steering helm and said propulsion unit and mounted remote from said propulsion unit; said power steering assist means including a hydraulic fluid cylinder-piston assembly having a reciprocally mounted piston thereby defining a chamber to either side of said piston to accommodate hydraulic fluid, and actuated in response to steering actuation at said steering helm; said cylinder-piston assembly having first valve means, and hydraulic fluid source means for delivery of pressurized hydraulic fluid to said cylinder-piston assembly; actuatable input means for accepting said mechanical output force and operably connected (a) to said steering helm and actuated in response to steering actuation at said steering helm and (b) to said power steering assist means to effect actuating input to said power steering assist means upon actuation at said steering helm; actuatable output means operably connected (c) to said power steering assist means and (d) to said steering member for overcoming torque on said propulsion unit relative to said steering axis in response to actuation of said actuatable output means, said actuatable output means providing actuatable output to effect common movement of said steering member in response to steering actuation of said steering helm to pivot said propulsion unit about said steering axis; and means for maintaining anti-feed back upon failure of said fluid source means including second valve means to permit delivery of hydraulic fluid from said fluid source means to said chamber to either side of said piston thereby maintaining said chamber substantially full of hydraulic fluid during steering and upon reciprocal movement of said piston to maintain said cylinder-piston assembly hydraulically locked.

5. A power steering system according to claim 4 wherein said second valve means comprises a first check valve to permit flow of fluid to said chamber on the up-stroke side of said piston, and a second check valve to permit flow of fluid to said chamber on the down-stroke side of said piston.

6. A power steering system according to claim 4 or claim 5 and further including a coupling means for operatively engaging said actuatable input means with said actuatable output means upon manual steering.

* * * * *